US008500135B2

(12) United States Patent
Peruffo

(10) Patent No.: US 8,500,135 B2
(45) Date of Patent: Aug. 6, 2013

(54) ROLLERSKI OR SKATE WITH BRAKING SYSTEM AND METHOD FOR BRAKING SAID SPORTS ITEM

(76) Inventor: Andrea Peruffo, Vicenza (IT)

( * ) Notice: Subject to any disclaimer, the term of this patent is extended or adjusted under 35 U.S.C. 154(b) by 231 days.

(21) Appl. No.: 13/002,839

(22) PCT Filed: Jul. 31, 2009

(86) PCT No.: PCT/EP2009/059983

§ 371 (c)(1),
(2), (4) Date: Jan. 6, 2011

(87) PCT Pub. No.: WO2010/012835

PCT Pub. Date: Feb. 4, 2010

(65) Prior Publication Data

US 2011/0109053 A1 May 12, 2011

(30) Foreign Application Priority Data

Jul. 31, 2008 (IT) ..... VI2008A0182

(51) Int. Cl.
*A63C 17/14* (2006.01)

(52) U.S. Cl.
CPC ..... *A63C 17/14* (2013.01)
USPC ..... 280/11.204; 280/11.221; 280/87.041

(58) Field of Classification Search
USPC ..... 280/87.042, 87.041, 11.221, 11.204, 280/11.214, 11.27, 11.201, 11.28, 842
See application file for complete search history.

(56) References Cited

U.S. PATENT DOCUMENTS

| | | | | |
|---|---|---|---|---|
| 3,484,116 | A * | 12/1969 | Allen | 280/11.201 |
| 4,133,546 | A * | 1/1979 | Rosenblum | 280/842 |
| 4,445,699 | A * | 5/1984 | Darasko | 280/87.041 |
| 4,768,793 | A * | 9/1988 | Spencer | 280/842 |
| 4,943,075 | A * | 7/1990 | Gates | 280/842 |
| 5,398,950 | A * | 3/1995 | Tkaczyk | 280/11.233 |
| 5,704,617 | A * | 1/1998 | Stoughton et al. | 280/11.214 |
| 6,082,768 | A * | 7/2000 | Johnson | 280/842 |
| 6,398,237 | B1 * | 6/2002 | Attey | 280/87.042 |
| 6,592,129 | B1 * | 7/2003 | Gates | 280/11.204 |
| 6,676,138 | B1 * | 1/2004 | Rosso | 280/11.221 |
| 6,832,771 | B2 * | 12/2004 | Beck | 280/87.041 |
| 7,213,823 | B1 | 5/2007 | Vujtech | |
| 2006/0220336 | A1 | 10/2006 | Lin | |

FOREIGN PATENT DOCUMENTS

| | | |
|---|---|---|
| DE | 29505464 U1 | 7/1996 |
| WO | 0053276 A | 9/2000 |

* cited by examiner

*Primary Examiner* — Hau Phan
(74) *Attorney, Agent, or Firm* — IP Strategies

(57) ABSTRACT

A wheeled sport item, such as a roller ski or a roller skate, is suited to be applied to the foot of a user in order to allow the foot to slide in relation to the ground according to a movement direction parallel to the foot. The sport item includes an elongated body associated with two wheels; a platform associated with the elongated body, defining a supporting surface for the foot; and a brake for braking the wheels. The item also includes a connector for connecting the platform to the elongated body, which defines a rotation axis orthogonal to the supporting surface, in order to allow a rotation of the foot, and a controller sensitive to the rotation of the foot for the operation of the brake.

12 Claims, 5 Drawing Sheets

ROLLERSKI OR SKATE WITH BRAKING SYSTEM AND METHOD FOR BRAKING SAID SPORTS ITEM

FIELD OF THE INVENTION

The present invention concerns a braking device for wheeled sports items to be applied to the foot of a user, particularly suited to be used in roller skis, also known as ski rolls, and roller skates, particularly in line skates.

The invention concerns also a sports item of the type described above, in particular a roller ski or a roller skate, comprising said braking device.

The invention also concerns a braking method for sports items of the type described above.

BACKGROUND OF THE INVENTION

As is known, roller skis are items used on roads which generally replace Cross Country skis, and make it possible to exercise during summer or in any other circumstance in which snow tracks are not available.

Roller skis generally comprise a pair of elongated bodies that the user applies to his/her feet with suitable bindings and are provided with wheels for moving on the ground, thus imitating the sliding movement of skis on snow.

In particular, roller skis are generally provided with bindings similar to those used for snow skis, so that they can be used with a technique very similar to that used for snow skis.

As is known, snow skis, and in particular Cross Country skis, are generally braked using the so-called "snowplough" technique, which consists in turning the points of one or both skis inwards, in order to form a "V" converging in the skier's advance direction.

In this way, the skis are incident on each other and on the advance direction, in order to exploit the friction of their edges with snow.

This technique allows the skier to brake while keeping his/her feet resting on the skis, in such a way as to distribute his/her weight on the feet soles and thus maintain a good balance and a good control of the skis.

As regards the roller skis of known types, they pose the drawback that they cannot be braked by means of the above mentioned snowplough technique.

In fact, due to the high friction between the wheels and the ground, it is not possible to place the roller skis incident to the advance direction without immediately crossing them, which inevitably leads to a fall.

In order to overcome the above mentioned drawback, braking devices for roller skis are known, which comprise braking calipers associated with the wheels and operated by means of levers seized by the user.

BRIEF SUMMARY OF THE INVENTION

A first drawback posed by said braking devices is due to the fact that to operate them it is necessary to use the hands, thus interfering with the main function of the hands, that is, to ensure balance.

Therefore, there is the drawback that the braking action makes the user lose his/her balance, so that he/she can fall down and be injured.

In another braking device of known type there is a moving platform associated with the elongated body, on which the user rests his/her foot and which allows the vertical movement of the heel or tip for operating the braking means.

This second type of braking device poses the drawback that it does not allow the user to keep his/her balance and to control the sports items as he/she would do with snow skis.

In fact, according to the braking technique described above the user transfers his/her weight on the heel or on the tip, and cannot distribute it as he/she likes on the entire foot sole.

A further drawback of both the braking techniques described above is represented by the fact that they are different from the techniques usually employed with snow skis, and therefore require specific training even for expert skiers, since it is necessary to get acquainted with such techniques.

It is evident that the drawbacks described above occur also with other types of sports items on wheels, in particular with roller skates, which operate according to the same principle as roller skis and substantially pose the same problems when it comes to braking.

BRIEF DESCRIPTION OF THE DRAWINGS

A known type of roller skates is provided with a braking device of static type, which generally consists of a pad, arranged on the front and/or rear part of the elongated body of the skate, which is placed in contact with the ground by bending the foot in order to obtain a friction effect.

It is clear that the braking device of the above mentioned type poses the drawback that it affects the user's balance during braking, even more than in the braking systems described above used for roller skis.

The present invention intends to overcome all the drawbacks of the known art as outlined above.

In particular, it is a first object of the invention to provide a braking device for a sports item on wheels to be applied to the foot of a user, in particular a roller ski or a roller skate that, during braking, allows the user to keep his/her balance and to control the sports item in a way that is comparable to that allowed by snow skis.

It is also the object of the invention to provide a braking device that allows the user to brake by performing a movement similar to the snowplough movement, with one foot or both feet.

The objects described above are achieved by a braking device carried out according to the main claim.

The same objects are also achieved by a sports item comprising the above mentioned braking device carried out according to claim 9.

The same objects are also achieved by a braking method implemented according to claim 10.

Further details of the braking device, the sports item and the method of the invention are described in the related dependent claims.

DETAILED DESCRIPTION OF THE INVENTION

Advantageously, the greater stability of the user during braking reduces the risk of him/her losing balance, which may make him/her fall down.

Still advantageously, since the braking effect is obtained with a movement that is analogous to the snowplough movement, the user can adopt a technique already learnt with snow skis and therefore he/she will find it easier to brake.

Figure 1:
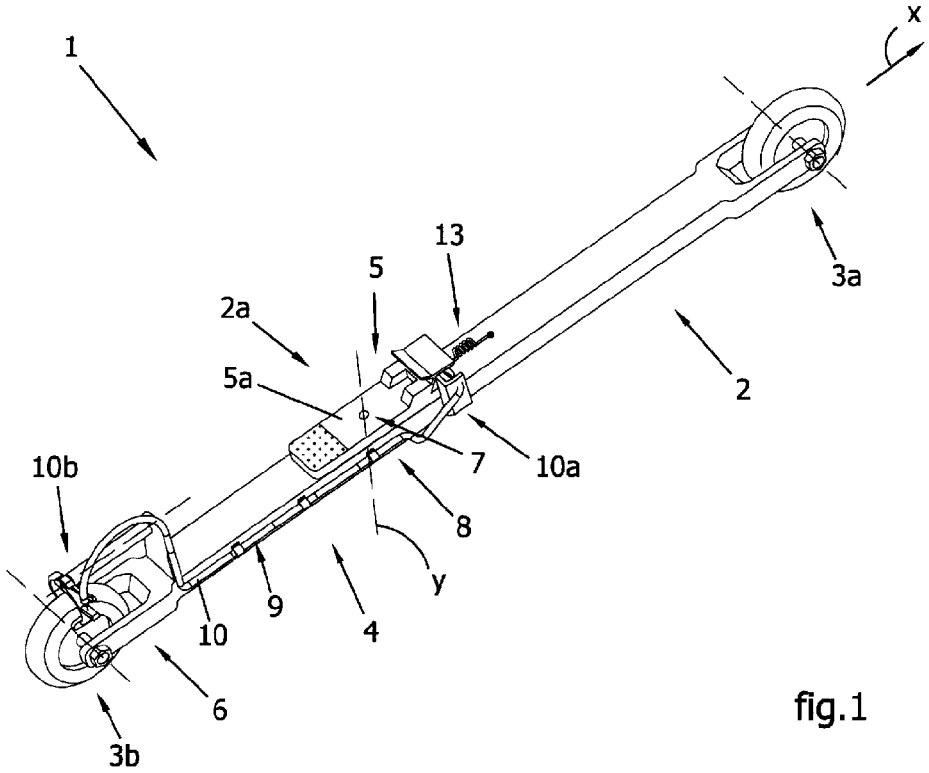
Figure 2:
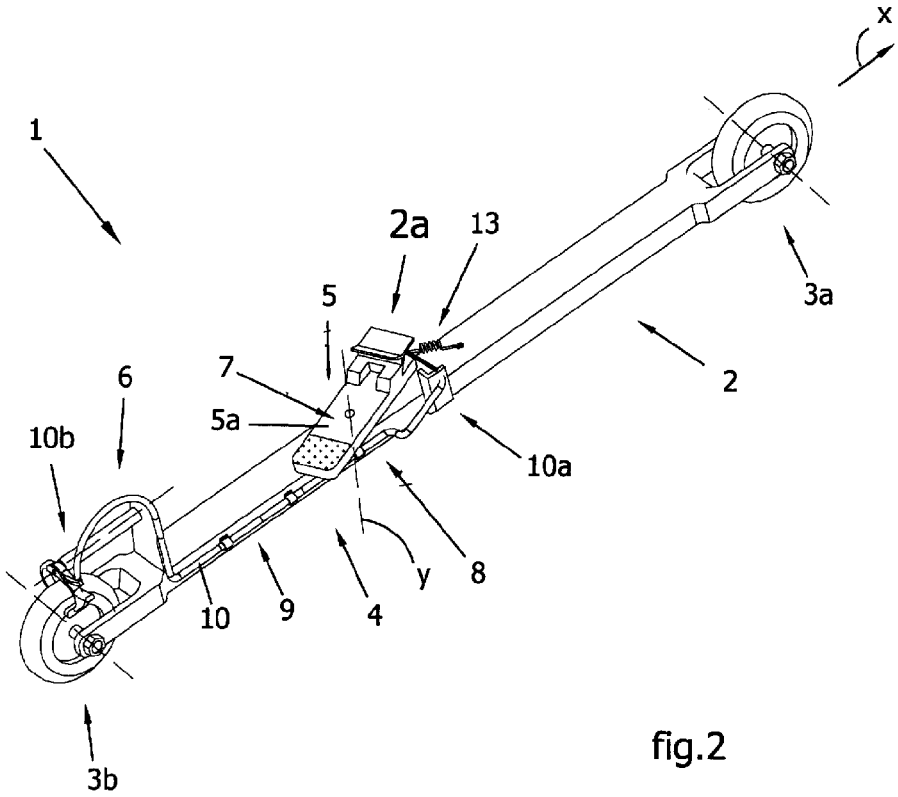
Figure 3:
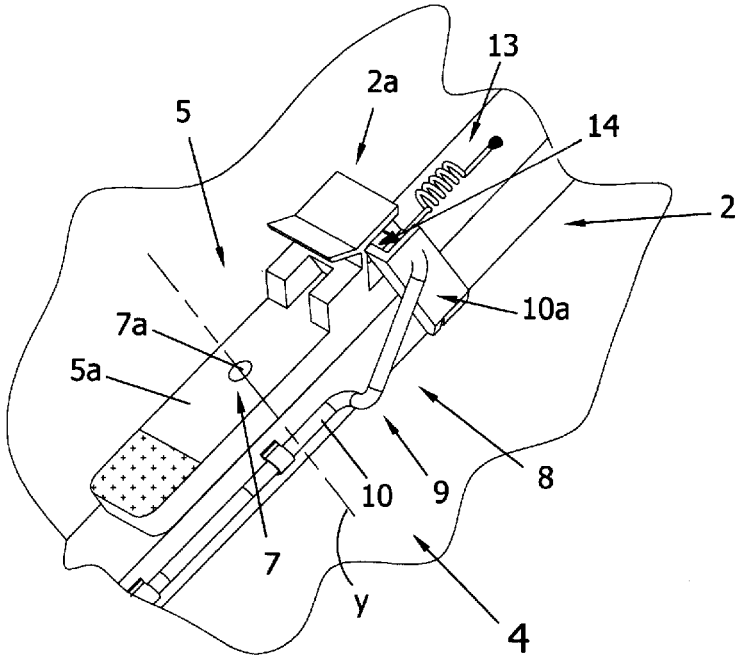
Figure 4:
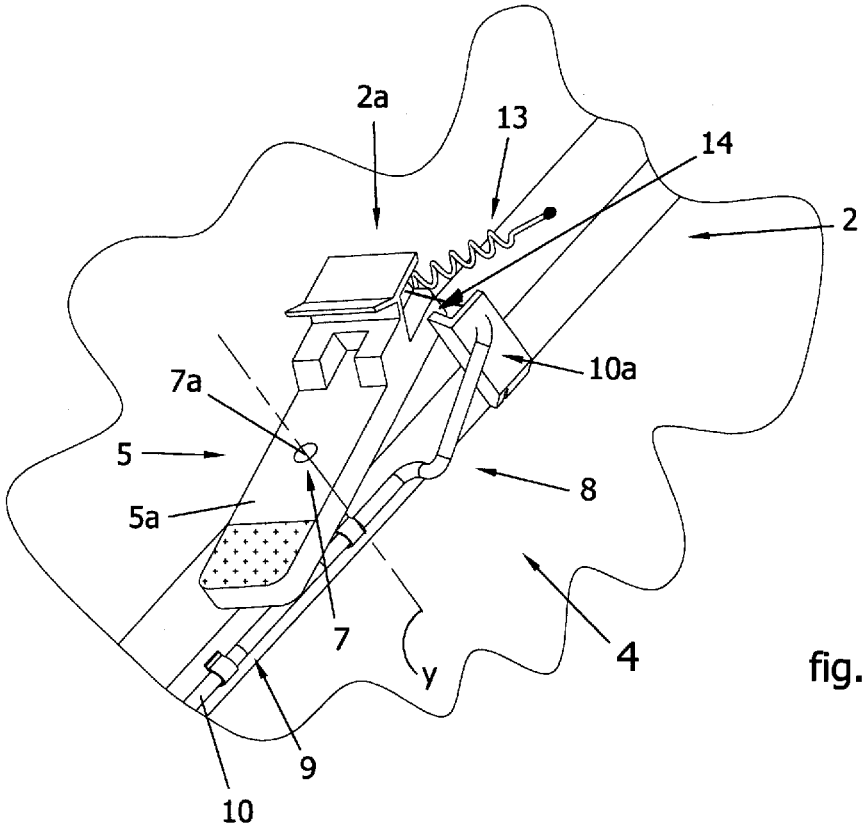
Figure 5:
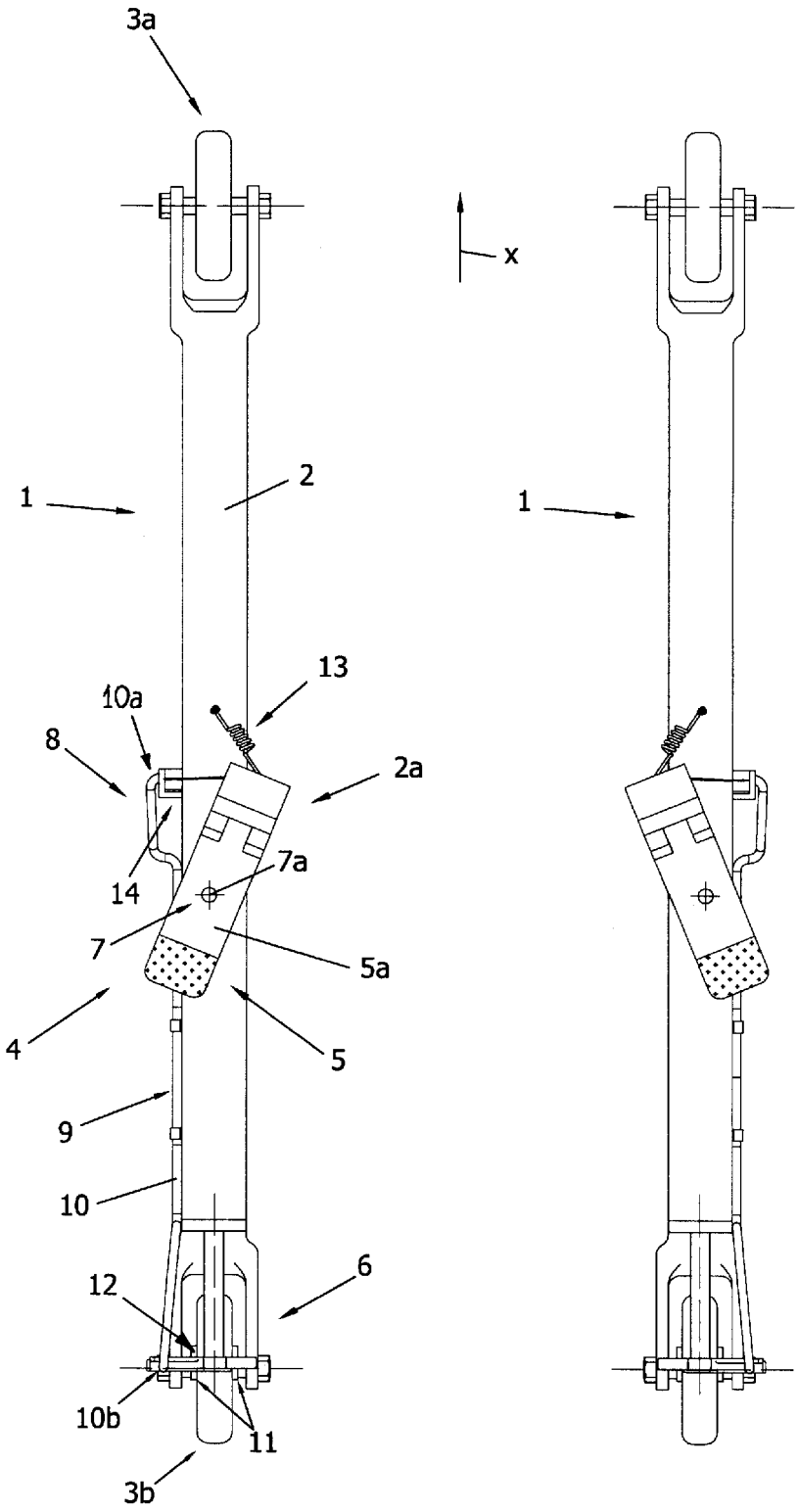
Figure 6:
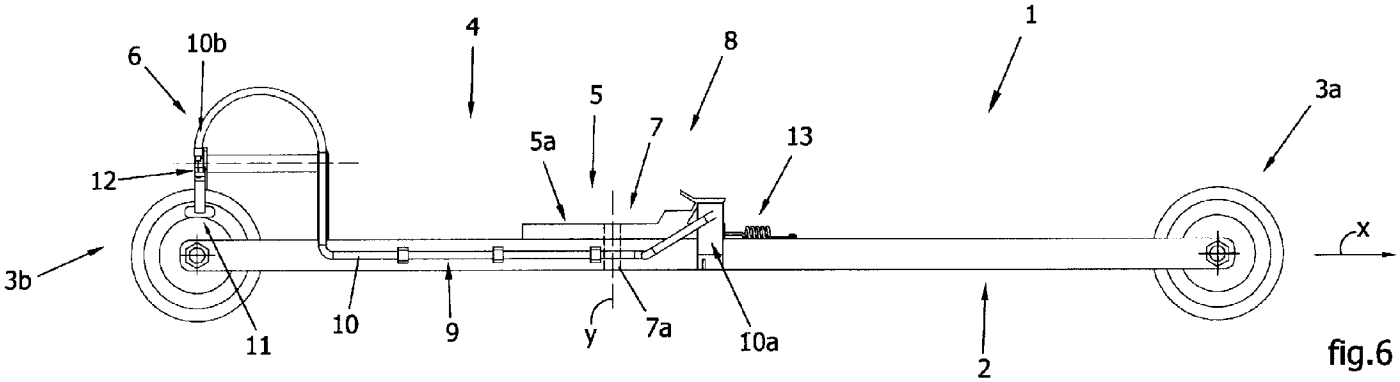
Figure 8:
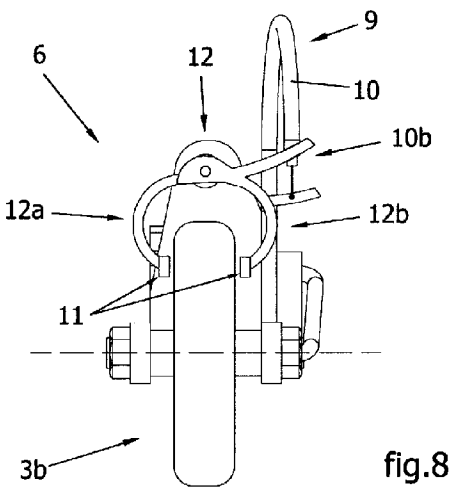
Figure 7:
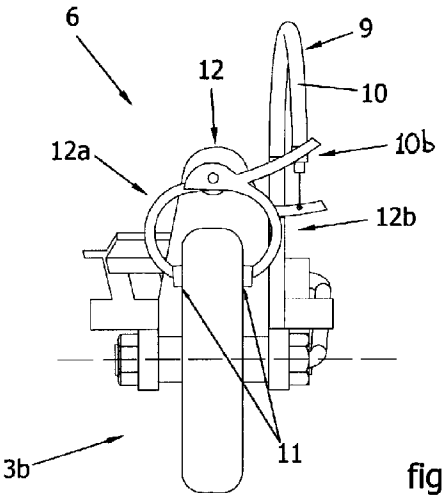
Figure 9:
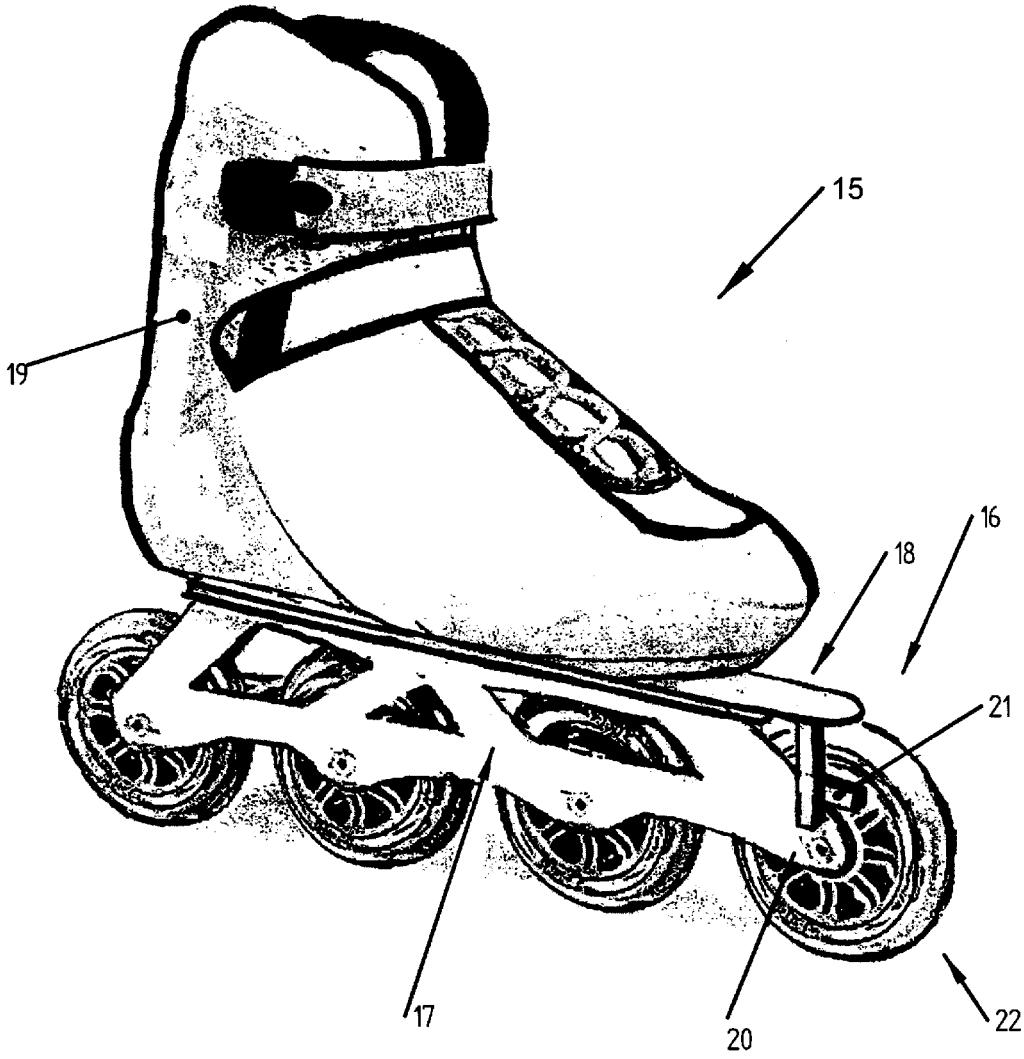

The said objects and advantages, and others which are better highlighted below, will be illustrated in detail in the description of two preferred embodiments of the invention which is provided by way of non-limiting example with reference to the attached drawings, wherein:

FIGS. 1 and 2 show a first embodiment of the sports item that is the subject of the invention, equipped with the braking device of the invention, in two different operating configurations and in axonometric view;

FIGS. 3 and 4 show a detail of FIGS. 1 and 2, respectively;

FIG. 5 shows a pair of sports items like the one shown in FIG. 1, in a particular operating configuration;

FIG. 6 shows a side view of the sports item of FIG. 1;

FIGS. 7 and 8 show a rear view of a detail of the braking device that is the subject of the invention, in two different operating configurations;

FIG. 9 shows a second embodiment of the sports item that is the subject of the invention.

According to a first embodiment, shown in FIG. 1, the braking device 4 of the invention is used on a roller ski 1.

For the sake of simplicity, only one ski is illustrated and described, but the user will normally use one ski for each foot.

It is clear that the details given herein are valid for both skis.

As shown in FIG. 1, the item 1 of the invention comprises an elongated body 2 that can be applied to the user's foot.

The elongated body 2 is preferably provided with a device 2*a* for binding the foot, for example analogous to those used in Cross Country skis and schematically shown in the figure.

The elongated body 2 is also provided with two wheels 3*a*, 3*b* resting on the ground, which define for said elongated body 2 a movement direction X.

It is evident that in construction variants of the invention, not illustrated herein, in the item 1 the number of wheels may also exceed two.

The braking device 4 is provided with braking means 6 which preferably act on one wheel 3*b* but however, in construction variants of the invention, may also act on more than one wheel.

As shown in particular in FIGS. 3 and 4, the braking device 4 comprises a platform 5 defining a surface 5*a* for resting the foot thereon.

According to the invention, the platform 5 is rotatingly connected to the elongated body 2 via connection means 7 that define for the platform 5 a rotation axis Y substantially orthogonal to the supporting surface 5*a* and preferably vertical.

The above mentioned connection means 7 allow the user to rotate the platform 5 in relation to the elongated body 2 through a torsion of the foot from an advance position, which is assumed during the normal pace and is illustrated in FIGS. 1 and 3, to a braking position illustrated in FIGS. 2 and 4.

As shown in FIG. 6, the connection means 7 preferably consist of a pin 7*a* and can also comprise guide elements, not illustrated herein, to ensure greater support to the platform and also the regular rotation of the latter.

Going back to FIG. 1, the braking device 4 comprises also control means 8 that are sensitive to the above mentioned torsion of the foot and are suitable for operating the braking means 6 when the foot is arranged in the braking position.

In this way, at any moment during his/her advance, the user may operate the braking means 6 of one or both skis 1 by a simple torsion of his/her feet.

Since a torsion of the foot allows the user to maintain his/her weight well balanced on the foot sole and, however, with no need to move it excessively, it is clear that he/she can maintain a good balance and good control of the skis during braking, thus achieving one of the objects of the invention.

Preferably, in the advance position, the foot is parallel to the item 1 and to the movement direction X while in the braking position the foot is incident on the item 1 and the movement direction X.

In this way, the user brakes by placing his/her feet in directions incident on their direction of movement X, as shown in FIG. 5, similarly to a skier during a snowplough braking.

Therefore, the braking device 4 described above also achieves the object to allow the user to brake the items 1 by performing a movement that is similar to the snowplough movement.

As regards the braking means 6, they comprise friction elements 11 arranged in proximity to a wheel 3*b* and associated with the elongated body 2 via articulation means 12.

The articulation means 12 define for the friction elements 11 a rest position spaced from the wheel 3*b*, illustrated in FIG. 8, and a friction position, in which they are placed in contact with the wheel 3*b* in order to brake, shown in FIG. 7.

In particular, each friction element 11 comprises a friction surface facing the wheel 3*b*, which is placed in contact with it in order to brake.

The wheels 3*a*, 3*b* are preferably covered with a rubber part for the contact with the ground, which is advantageously used also as an element of contact with the friction surface.

It is evident that the friction elements 11 can be made of any material, for example rubber, metal or a plastic material, and/or in any shape, provided that said friction elements 11 are suitable for braking the wheel.

The articulation means 12 preferably but not necessarily comprise two opposing jaws 12*a*, 12*b*, each one provided with a corresponding friction element 11 and operatively connected to the above mentioned control means 8.

It is evident that further construction variants of the invention may comprise braking means of any other known type.

FIGS. 1 and 2 show that the control means 8 comprise drive means 9 that preferably but not necessarily comprise a cable 10 associated with the platform 5 at a first end 10*a* and connected with the articulation means 12 with the opposite end 10*b*.

Advantageously, the cable 10 transmits the movement of the platform 5 to the articulation means 12, which therefore push the friction element 11 against the wheel 3*b* with increasing force as the rotation angle of the foot and therefore of the platform 5 in relation to the advance position increases.

In this way, the braking force is proportional to the foot torsion and therefore, advantageously, reproduces even more faithfully the effects of the snowplough braking.

It is evident that in other construction forms of the invention the drive means can be different from a cable, for example they may comprise a lever system, an hydraulic duct or any other type of means suited to transmit the rotary motion of the platform 5 to the braking means 6.

According to a different embodiment of the invention, not illustrated herein, the control means are independent of the platform and comprise a lever, arranged beside the user's foot at the level of the tip or heel, said lever being pushed by the foot when it is rotated.

The braking device 4 preferably comprises adjusting means, not illustrated herein but known per se, which advantageously allow the user to adjust as desired the intensity and/or response of the braking means 6 with the same foot torsion angle, in such a way as to adapt them to his/her body weight, to the type of ground and other personal needs.

The platform 5 is preferably associated with elastic means 13 that spontaneously bring it to the advance position, in order to advantageously prevent the accidental torsion of the foot and thus facilitate the use of the item 1 in normal advance conditions.

Preferably, the above mentioned elastic means 13 are provided with a preload that the user must overcome in order to be able to rotate the foot in relation to the advance position.

Advantageously, the preload makes the advance position stable and therefore further facilitates the use of the item in normal advance conditions, beside avoiding the involuntary braking of the items 1.

The above mentioned elastic means 13 are preferably associated with the platform 5.

According to a construction variant of the invention, the elastic means are associated with the articulation means 12 in order to advantageously serve as an element for the elastic return of the friction element 11 to the rest position.

Locking means may also be provided, in replacement of or in addition to the elastic means 13, said locking means being suited to make the advance position preferential for the platform 5 itself, in order to ensure further stability to and prevent any accidental rotation of the platform 5 during the advance movement.

Said locking means, not illustrated herein, can be released by the user by to rotating the platform 5 with a force exceeding a prefixed threshold level.

Said locking means may comprise, for example, rounded shapes of the pin 7*a* and of the elongated body 2 matching each other, mutually constrained by the weight of the user.

According to a construction variant of the invention, said locking means comprise moving elements for constraining the platform 5 to the elongated body 2, for example spherical bodies removably held in position by springs.

Preferably, and as shown in detail in FIGS. 3 and 4, stop means 14 are provided to limit the rotation of the platform 5, preventing the rotation of the foot from the advance position in the direction opposite the braking direction.

The stop means 14 advantageously make it easy for the user to maintain the normal advance position.

The invention preferably includes also stop means suited to limit the rotation of the platform 5 beyond the braking position, said means not being illustrated herein but advantageously avoiding excessive torsion of the foot during braking.

From an operational point of view, during the normal advance movement the user's feet are directed in the advance direction X of the items 1 and follow their movement, while the friction elements 11 are in rest position, as shown in FIG. 8 by way of example.

In order to brake, the user places the items 1 parallel to each other and exerts a torsion of the feet inwards, as shown in FIG. 5, so that the tips converge, thus assuming a position similar to that of the snowplough movement.

Obviously, even if the user rotates his/her feet with respect to the advance direction X, the items 1 maintain said direction owing to the friction between the wheels 3*a*, 3*b* and the ground.

Therefore, the torsion of the feet causes the rotation of the platform 5 in relation to the elongated body 2 of the items, thus stretching the cable 10 and transmitting this effect to the articulation means 12 in order to push the friction elements 11 against the wheel 3*b*, as shown in FIG. 7.

Once the braking operation has been completed, the user lets the platform 5 spontaneously return to the advance position defined by the elastic means 13 and by the stop means 14, and finally his/her feet are again parallel to the advance direction X.

It is evident that the braking action described above can even be performed on one item 1 only, by turning only the corresponding foot instead of both feet, according to a technique that is known for snow skiing and skating as well.

The present invention is suitable not only for roller skis as described above, but for any type of sports item with wheels that can be applied to the feet, for example roller skates, in particular in line skates, schematically shown in FIG. 9 and therein indicated as a whole by 15.

The above mentioned in line skate 15 is provided with a braking device 16 substantially equivalent to the one described above for roller skis, provided with a platform 18 rotatingly connected to the elongated body 17 and incorporating a boot 19 where the user fits his/her foot.

The braking means 20 comprise a friction element 21 associated with the platform 18, which is pushed against the front wheel 22 of the skate 15 when the platform 18 is rotated through a torsion of the foot, in such a way as to brake.

It is evident, therefore, that the braking action is similar to that described for roller skis, with the only difference that the braking means 20 are operated without the interposition of drive means.

It is evident, however, that according to construction variants of the invention, not illustrated herein, the motion of the platform 18 can be transmitted to the friction element 21 through a lever system, or gear wheels or through any other equivalent type of drive means.

Advantageously, the above mentioned drive means can feature a reduction ratio between the rotation of the platform 18 and the movement of the friction element 21, thus allowing the braking to be more precise and gradual.

The above shows that the braking device, the sports items and the method of the invention achieve all the set objects.

In particular, braking by means of a torsion of the feet allows the user to operate the braking device while keeping his/her balance and maximum control of the items.

Furthermore, the braking movement is substantially analogous to that adopted for braking snow skis, which makes it more direct and natural.

On implementation, the braking device, the sports items and the method that are the subjects of the invention may undergo changes that, though not illustrated or described in the drawings, shall nonetheless be covered by the present patent, provided that they come within the scope of the claims that follow.

The invention claimed is:

1. A wheeled sport item to be applied to the foot of a user in order to allow said foot to slide in relation to the ground according to a movement direction parallel to said foot, comprising:

an elongated body associated with at least two wheels that define for said elongated body said movement direction;

a platform associated with said elongated body and defining a supporting surface for said foot;

means for braking at least one of said wheels;

means for connecting said platform to said elongated body, which define for said platform a rotation axis substantially orthogonal to said supporting surface, thereby allowing a rotation of said foot relative to said movement direction, between a first position, wherein in said first position said foot is substantially parallel to said movement direction, and a second position, wherein in said second position said foot is incident on said movement direction; and control means responsive to the rotation of said foot around said rotation axis and adapted to operate said braking means when said foot is arranged in a braking position corresponding to said second position.

2. The wheel sport item according to claim 1), wherein said braking means comprise at least one friction element arranged in proximity to at least one of said wheels and associated with said elongated body through articulation means suited to arrange said friction element in any position included between a rest position spaced from said wheel and a friction position in contact with said wheel.

3. The wheel sport item according to claim 2), wherein said articulation means comprise a pair of jaws arranged on opposite sides with respect to said wheel.

4. The wheel sport item according to claim 2), wherein said control means comprise drive means operatively connected to said platform.

5. The wheel sport item according to claim 4), wherein said drive means comprise a cable provided with a first end associated with said platform and an opposite end associated with said articulation means.

6. The wheel sport item according to claim 1), further comprising elastic means for the spontaneous return of said platform to said first position.

7. The wheel sport item according to claim 1), further comprising stop means suited to limit the rotation of said platform between said first position and said braking position.

8. The wheel sport item according to claim 1), comprising a roller ski.

9. The wheel sport item according to claim 1), comprising a roller skate.

10. A method for braking a wheeled sport item suited to be applied to the foot of a user in order to allow said foot to slide in relation to the ground according to a movement direction parallel to said foot, comprising:

an elongated body associated with at least two wheels that define for said elongated body said movement direction;

a platform associated with said elongated body and defining a supporting surface for said foot; and means for braking said wheels;

said method comprising the step of operating said braking means through the rotation of said foot around a rotation axis, so that, during said rotation, said foot passes from a first position, parallel to said movement direction, to a braking position, incident on said movement direction, wherein said rotation axis is substantially orthogonal to said supporting surface.

11. The method according to claim 10), wherein the wheeled sport item comprises a roller ski.

12. The method according to claim 10), wherein the wheeled sport item comprises a roller skate.

* * * * *